US006083896A

United States Patent [19]

Inbe et al.

[11] Patent Number: 6,083,896

[45] Date of Patent: Jul. 4, 2000

[54] AQUEOUS CLEANING SOLUTION AND METHOD FOR CLEANING ALUMINUM-BASED METALS

[75] Inventors: Toshio Inbe, Kanagawa-ken; Shinji Sasakuma, Tokyo-to; Yasutake Mino, Hyogo-ken; Satoshi Ikeda, Kanagawa-ken, all of Japan

[73] Assignee: Nippon Paint Co., Ltd., Osaka-fu, Japan

[21] Appl. No.: 09/362,732

[22] Filed: Jul. 29, 1999

[30] Foreign Application Priority Data

Jul. 30, 1998 [JP] Japan ..... 10-215205
Jul. 6, 1999 [JP] Japan ..... 11-191763

[51] Int. Cl.[7] ..... C11D 3/02; C11D 14/02; C23G 1/02; C23G 14/02

[52] U.S. Cl. ..... 510/254; 510/255; 510/270; 510/271; 510/421; 510/508; 134/3; 134/41

[58] Field of Search ..... 510/254, 255, 510/270, 271, 421, 508; 134/3, 41

[56] References Cited

U.S. PATENT DOCUMENTS

| | | | |
|---|---|---|---|
| 4,728,456 | 3/1988 | Yamasoe et al. | 252/142 |
| 4,851,148 | 7/1989 | Yamasoe et al. | 252/142 |
| 4,886,616 | 12/1989 | Yamasoe et al. | 252/142 |
| 5,279,677 | 1/1994 | Das | 134/3 |
| 5,336,425 | 8/1994 | Aoki et al. | 252/100 |
| 5,415,797 | 5/1995 | Ishida et al. | 252/135 |
| 5,545,347 | 8/1996 | Ouyang et al. | 510/254 |
| 5,584,943 | 12/1996 | Banaszak et al. | 148/246 |
| 5,688,755 | 11/1997 | Ikeda et al. | 510/254 |
| 5,925,613 | 7/1999 | Shinomiya et al. | 510/421 |

FOREIGN PATENT DOCUMENTS

| | | |
|---|---|---|
| 0 196 668 | 10/1986 | European Pat. Off. . |
| 0 789 094 | 8/1997 | European Pat. Off. . |

*Primary Examiner*—John M Petruncio
*Attorney, Agent, or Firm*—Wenderoth, Lind & Ponack, L.L.P.

[57] ABSTRACT

The present invention provides an aqueous cleaning solution for aluminum-based metals which comprises an inorganic acid in an amount to provide a pH value of 2 or less, an oxidized form metal ion and a surfactant represented by the following formula (I)

$$R—O—(EO)_nH \quad (I)$$

wherein R represents an alkyl group having on average 10 to 18 carbon atoms per molecule, n represents an integer of 8 or greater, and EO represents an ethyleneoxy group which may contain a small proportion of a propyleneoxy group. The degradation of cleaning properties due to the accumulation of lubricating oil or decomposition of surfactants is lessened even when the cleaning operation is carried out for a long period of time.

7 Claims, No Drawings

AQUEOUS CLEANING SOLUTION AND METHOD FOR CLEANING ALUMINUM-BASED METALS

BACKGROUND OF THE INVENTION

The present invention relates to an aqueous cleaning solution and a method for leaning aluminum-based metals. More specifically, the present invention relates to an aqueous cleaning solution and a method for cleaning aluminum-based metals characterized by excellent cleaning action in the removal of lubricating oil, aluminum powder and the like adherent to the surface of aluminum. Further, the present invention relates to an aqueous cleaning solution lessened influences on living things and environments, and a method for cleaning aluminum-based metals thereby.

Manufactured articles having aluminum surface, for example, beverage containers made from an aluminum-based metal (i.e., aluminum or an aluminum alloy), are fabricated by a forming operation which is usually called drawing and ironing (hereinafter referred to as DI processing). Lubricating oil is applied to metal surface in this forming operation. Further, aluminum powder or a reaction product (i.e., smut) between the aluminum powder and the lubricating agent adheres to the containers obtained and to inner walls thereof in particular. Later, usually these containers are subjected to a chemical conversion treatment or coated with a paint for surface protection. In order to conduct these treatments uniformly and perfectly, it is necessary to cleanse the surface by removing the lubricating oil and the smut from metal surface prior to the chemical treatment.

In the surface cleansing process, an acid cleaning agent, which cleans by appropriately etching metal surface, is generally used in order to remove an oxide film and the like formed on the surface of aluminum. Heretofore, a chromic- or hydrofluoric acid-based cleaning agent has been often used as the acid cleaning agent. These cleaning agents contain harmful substances, however. Therefore, in recent years, it has been desired the establishment of a chromium-free and fluorine-free acid cleaning technique which is performed at a lower temperature.

Japanese Patent Application Publication (JP-B) Nos. 3-50,838 and 3-65,436 propose a chromium-free and fluorine-free acid cleaning technique.

Disclosed in these publications are an acid cleaning agent which contains a little or no fluorine ion and has a pH value adjusted to 2 or less by sulfuric acid and/or nitric acid and which further contains a ferric ion in place of the fluorine ion for the acceleration of etching, and a controlling method in which the concentration of the ferric ion in the cleaning bath is controlled by controlling the oxidation-reduction potential of the bath.

Normally, the aluminum etching reaction in an acid cleaning agent consists of an anodic reaction in which aluminum becomes aluminum ions ($Al^{3+}$) and an cathodic reaction in which $H^+$ in the cleaning solution is reduced to become ½ $H_2$. Therefore, if ferric ions ($Fe^{3+}$) are added to the acid cleaning solution, an anodic reaction, in which ($Fe^{3+}$) is reduced to $Fe^{2+}$, takes place concurrently with the reduction of $H^+$. As a result, the etching reaction of aluminum is accelerated.

Further, control of the oxidation-reduction potential of the cleaning bath by the oxidizing agent makes it possible to suppress the concentration of $Fe^{2+}$, which increases as the etching reaction of the aluminum proceeds, and to oxidize $Fe^{2+}$ to $Fe^{3+}$.

Besides, Japanese Patent Application Laid-Open (JP-A) No. 7-173,655 discloses an aqueous acid cleaning solution comprising a chelating dispersant and a surfactant in addition to the inorganic acid and oxidized form metal ion, as an attempt to prevent the formation of precipitate derived from iron ions and to further improve the leaning properties.

However, in the cleaning methods using any of the above-described cleaning agents, the cleaning properties are degraded due to the accumulation of lubricating agents if cleaning operation is continued for a long period of time. Further, measures, such as addition of a large amount of surfactants or increase of the amount of auto-drain for the reduction of the accumulation of the lubricating agent, lead to the increase in running costs and increase of the load of waste water. Furthermore, an alkylphenol-based surfactant, which has been often used, presents environmental problems because it is suspected of being an environmental hormone and because its biodegradability is insufficient.

Still further, the addition of the oxidizing agent causes oxidative decomposition of the surfactant and the decomposed products accumulate in the acid cleaning solution, thus degrading the cleaning properties.

SUMMARY OF THE INVENTION

The object of the present invention is to provide an aqueous cleaning solution and a method for cleaning aluminum-based metals in which the degradation of cleaning properties due to the accumulation of lubricating oil or decomposition of surfactants is lessened even when the cleaning operation is carried out for a long period of time and further environmental problems are abated even when the cleaning solution is discarded outside.

The present invention relates to an aqueous cleaning solution for aluminum-based metals which comprises an inorganic acid in an amount to provide a pH value of 2 or less, an oxidized form metal ion in an amount of 0.05 to 4 g/L, and a surfactant in an amount of 0.05 to 10 g/L; said surfactant is represented by the following formula (I)

$$R—O—(EO)_nH \quad (I)$$

wherein R represents an alkyl group having 10 to 18 carbon atoms per molecule on average, n represents an integer of 8 or greater, and EO represents an ethyleneoxy ($—CH_2CH_2O—$) group which may contain a small proportion of a propyleneoxy ($—C_3H_6O—$) group.

DETAILED DESCRIPTION OF THE INVENTION

The present invention relates to an aqueous cleaning solution for aluminum-based metals which comprises an inorganic acid in an amount to provide a pH value of 2 or less, an oxidized form metal ion in an amount of 0.05 to 4 g/L, and a surfactant in an amount of 0.05 to 10 g/L; said surfactant is represented by the following formula (I)

$$R—O—(EO)_nH \quad (I)$$

wherein R represents an alkyl group having 10 to 18 carbon atoms per molecule on average, n represents an integer of 8 or greater, and EO represents an ethyleneoxy ($—CH_2CH_2O—$) group which may contain a small proportion of a propyleneoxy ($—C_3H_6O—$) group.

More specifically, the present invention relate to the above-described aqueous cleaning solution wherein R of the surfactant represented has 12 to 18 carbon atoms per molecule on average and has a molecular weight of 600 or greater.

More specifically, the present invention relate to the above-described aqueous cleaning solution wherein R of the surfactant represented has 12 to 18 carbon atoms per molecule on average and has a molecular weight of 900 or greater.

Further, the present invention relates to a process for cleaning aluminum-based metals by the above-described aqueous cleaning solution wherein the concentration of the oxidized form metal ion in the aqueous cleaning solution is maintained by supplementing an oxidizing agent or an oxidizing agent and an oxidized form metal ion.

Furthermore, the present invention relates to an aluminum manufactured article obtained by undergoing a cleaning process conducted using the above-described aqueous cleaning solution.

Feature of the present invention is in that a specific surfactant is added to an aqueous acid cleaning solution which contains at least an oxidized form metal ion. The addition of the specific surfactant makes it possible to provide a cleaning solution for aluminum-based metals which has excellent cleaning action hitherto unattainable. By contrast with similar conventional cleaning solutions, the particularly excellent features of the cleaning solution of the present invention derive from the excellent cleaning action and are pointed out as follows. First, the excellent cleaning action is exhibited by a short-time contact between a metal to be cleaned and the cleaning solution; second, the cleaning solution still maintains an excellent cleaning power even at a stage when a considerably large amount of oil such as lubrication oil is accumulated in the cleaning solution; and, third, the surfactant to be used is so resistant to oxidative decomposition that the cleaning solution maintains the excellent cleaning power for a long period of time even in a system which contains an oxidizing agent.

Consequently, the large amount of auto-drain can be reduced in the use of the aqueous cleaning solution of the present invention. Therefore, the addition of a fresh surfactant following auto-drain is not necessary and the costs for waste water disposal can be reduced. As a result, since the cost for cleaning process is reduced, a large economical advantage can be created.

Furthermore, feature of the present invention is in that the surfactant to be used has excellent biodegradability and is free from apprehension of adverse influence as an environmental hormone on ecology unlike an alkylphenol-based surfactant which has been conventionally used for the same purpose. As described above, also in the aspect of influences on environment, the cleaning solution of the present invention is free from problems.

The surfactant to be formulated in the aqueous cleaning solution of the present invention for aluminum-based metals is represented by the following structural formula (I)

$$R—O—(EO)_nH \quad (I)$$

wherein R represents an alkyl group having on average 10 to 18 carbon atoms per molecule, n represents an integer of 8 or greater, and EO represents an ethyleneoxy group which may contain a small proportion of a propyleneoxy group.

Preferably, R is an alkyl group having 12 to 18 carbon atoms per molecule on average and has a molecular weight of 600 or greater. More preferably R has a molecular weight of 900 or greater, and most preferably 1000 to 15000.

The surfactant represented by the formula (I) is not necessarily limited to the use as a single compound. Therefore, R, n, and the molecular weight specified above may be an average, respectively, of those derived from a mixture of surfactants.

If the average number of carbon atoms contained in the alkyl group represented by R is either less than 10 or more than 18, the cleaning properties are insufficient in the conditions where cleaning time is short or oil is accumulated, and the surfactant becomes more liable to decomposition by an oxidizing agent. As a result, the cleaning properties are degraded. On the other hand, the cleaning properties are also degraded by the same reason if n is 7 or less.

Although the alkyl group R is preferably a straight-chain alkyl group, it may be partially branched and may partially contain unsaturated bond.

The value of n may be advantageously 8 or greater. Preferably n is 8 to 40, more preferably 10 to 30, and most preferably n is 16 to 30. When n is less than 16, there is a case that the cleaning ability when the oil accumulated or after the cleaning solution aged may slightly decrease in some formulations, for instance, the ratio of the defoaming agent to the surfactant to be used. But, as the foamability of the surfactant within this range is usually lower, the defoaming agent can be reduced, so that the cleaning ability when the oil accumulation or after the aging of the cleaning solution can be improved by decreasing the defoaming agent.

Although EO stands for an ethyleneoxy group, it may include a small proportion of a propyleneoxy group. If the group EO contains propyleneoxy groups, the propyleneoxy groups may be introduced randomly or in the form of a block into the ethyleneoxy group. The content of the propyleneoxy group is preferably 30 mol % or less based on the ethyleneoxy group.

The surfactant represented by the formula (I) is contained in the aqueous acid solution preferably in an amount of 0.05 to 10 g/L and more preferably in an amount of 0.2 to 3 g/L. If the content of the surfactant is less than 0.05 g/L, the cleaning properties, in particular the degreasing property, tend to be reduced. On the other hand, a surfactant content of more than 10 g/L is uneconomical because no further enhancement in the cleaning properties is observed.

In the present invention, the term "oxidized form metal ion" refers to a metal ion having the highest valence when the metal ion has a plurality of valences. Specific examples of the oxidized form metal ion include a ferric ion ($Fe^{3+}$), a ceric ion ($Ce^{4+}$), a cobalt ion ($Co^{5+}$), and a stannic ion ($Sn^{4+}$). Preferably, the oxidized form metal ions are a ferric ion ($Fe^{3+}$) and a ceric ion ($Ce^{4+}$). These oxidized form metal ions are used alone or as a mixture of two or more of them.

Examples of the source of the ferric ion include water-soluble ferric salts such as ferric sulfate, ferric nitrate, and ferric perchlorate and the like. Examples of the source of the ceric ion include cerium ammonium sulfate and the like. Examples of the source of the cobalt ion include cobaltic sulfate, cobaltic ammonium sulfate, and the like. Examples of the source of the stannic ion include stannic sulfate, stannic nitrate, and the like.

The amount added of the oxidized form metal ion in the cleaning agent is 0.05 to 4 g/L and preferably 0.2 to 2 g/L. If the amount added of the oxidized form metal ion is less than 0.05 g/L, aluminum surface etching action becomes so insufficient that aluminum surface cleansing action, for example a desmutting property, is degraded. On the other hand, if the amount added of the oxidized form metal ion is more than 4 g/L, undesirable influences, such as locally excessive etching and decomposition of surfactants, take place.

In the present invention, the pH value of the cleaning solution is kept at 2 or below. In order to keep the pH value within this range, a necessary amount of an inorganic acid is added. The inorganic acid is preferably sulfuric acid, but nitric acid can be used partially together with sulfuric acid. If the pH value exceeds 2, the aluminum surface etching rate is extremely reduced and therefore the effectiveness as a cleaning bath is impaired.

As necessary, the cleaning solution of the present invention may contain at least one component selected from a chelating dispersant, a decomposition preventing agent, and a defoaming agent in addition to the inorganic acid, oxidized form metal ion, and surfactant represented by the formula (I).

The chelating dispersant is a compound which can form a chelate with the oxidized form metal ion so that the oxidized form metal ion is stabilized in a strong acid aqueous solution and which thus enhances the dispersibility of the oxidized form metal ion in the strong acid aqueous solution. Any compound having the above-described function may be used. The compound is preferably a phosphonic acid compound. Specific examples of the compound include 1-hydroxyethylidene-1,1-diphosphonic acid, aminotri (methylenephosphonic acid), ethylenediaminetetra (methylenephosphonic acid), and the like.

The content of the chelating dispersant in the cleaning solution is preferably 0.05 to 5 g/L and more preferably 0.1 to 2 g/L.

Examples of the defoaming agent usable in the present invention include EO- and PO-adducts (PO represents a propyleneoxy group) of higher alcohol such as $C_{12}H_{25}$—O—$(EO)_6(PO)_{18}H$, $C_{10}H_{21}$—O—$(EO)_5(PO)_{10}H$ and the like, and polypropylene glycol/ethyleneoxy adducts such as HO—$(EO)_2(PO)_{27}$—O—$(EO)_2H$ and the like.

The amount added of the defoaming agent is preferably 40 to 200% by weight based on the surfactant.

The decomposition preventing agent is used for the prevention or inhibition of the decomposition of the surfactant in a strong acid. Preferred examples of the decomposition preventing agent include bromine ions, polyhydric alcohol, and a combination of them.

The bromine ions can be added in the form of HBr, KBr, NaBr, aluminum bromide, or iron bromide.

The polyhydric alcohol is preferably a compound which has in the molecule at least two hydroxyl groups directly linked to adjacent carbon atoms of main chain. Examples of the polyhydric alcohol include dihydric alcohol, such as 1,2-ethanediol (ethylene glycol), 1,2-propanediol (propylene glycol), 1,2-pentanediol, and 1,2-butanediol, trihydric alcohol, such as 1,2,3-propanetriol and 1,2,4-butanetriol, and tetrahydric alcohol such as 1,2,3,4-butanetetraol.

Where these decomposition preventing agents are added, the amount added is 0.02 to 0.1 g/L for bromine ions, and 0.1 to 5 g/L for polyhydric alcohol in the cleaning solution.

According to the method of the present invention for cleaning aluminum-based metal, the concentration of the oxidized form metal ion in the aqueous cleaning solution is maintained by supplementing an oxidizing agent or an oxidizing agent and an oxidized form metal ion in the cleaning process.

As the cleaning action proceeds, the oxidized form metal ion is reduced to the ion having a lower valence. Therefore, the oxidizing agent is used to restore the ion having a lower valence to the original oxidized form ion so that the action of the oxidized form metal ion can be continued.

Usually, when a cleaning operation is carried out, an oxidized form metal ion, for example a ferric ion, changes to a ferrous ion by the reaction of $Fe^{3+}+e \rightarrow Fe^{2+}$ with lapse of time. As a result, the oxidation-reduction potential (ORP) is lowered (also known as aging of cleaning bath) to the extent that the effect to accelerate the etching of aluminum-based metal surface is lost. Accordingly, the oxidized form metal ion may be supplemented as and when necessary, but instead it is preferable to supplement the oxidizing agent as and when necessary for the purpose of controlling ORP so that ferrous ions are oxidized to ferric ions.

Examples of the oxidizing agent for use in the present invention include hydrogen peroxide, persulfates (e.g., $Na_2S_2O_8$), ozone ($O_3$), cerium compounds (e.g., cerium ammonium sulfate), nitrites (e.g., $NaNO_2$ and $KNO_2$, and compounds capable of forming metavanadate ions. In addition, other oxidizing agents disclosed in JP-B No. 3-65,436 can also be used.

As described above, in the present invention, the state of the cleaning bath is controlled by the oxidation-reduction potential as a basis for supplementing an oxidizing agent or an oxidizing agent and an oxidized form metal ion.

The method for cleaning aluminum-based metal surface with the aqueous cleaning solution of the present invention may be implemented by either spraying or immersion. In the cleaning operation, the treating temperature is preferably 35 to 80° C. and more preferably 50 to 70° C. At a temperature higher than 80° C., the surface is excessively etched and therefore the aging of the treating bath is undesirably accelerated. On the other hand, at a temperature lower than 35° C., the etching amount is so insufficient that the desmutting property is degraded.

The aluminum-based metal surface, which has been cleansed with the aqueous cleaning solution of the present invention, may be rinsed with water and thereafter subjected to a chemical treatment according to an ordinary way.

The present invention is more specifically explained by the following examples and comparative examples.

EXAMPLES 1 TO 11

Based on the formulations shown in Table 1, aqueous cleaning solutions having pH values shown in Table 1 were prepared by mixing, respectively, aqueous solutions of inorganic acids, oxidized form metal ions, surfactants, chelate decomposing agents, defoaming agents, and decomposition preventing agents. In the preparation, the aqueous solution of sulfuric acid and the aqueous solution of nitric acid as aqueous solutions of inorganic acids were added as a 75% solution of sulfuric acid in water and a 67.5% solution of nitric acid in water, respectively. $Fe^{3+}$ and $Ce^{4+}$ as oxidized form metal ions were added as a 41% aqueous solution of ferric sulfate and a 41% aqueous solution of ceric sulfate (tetrahydrate), respectively. 1-hydroxyethylidene-1,1-diphosphonic acid as a chelating agent, NaBr as a decomposition preventing agent, and $C_{12}H_{25}$—O—$(EO)_6(PO)_{18}H$ as a defoaming agent were added directly to the aqueous cleaning solutions, respectively. The molecular weights of the surfactants used are also shown in Table 1.

COMPARATIVE EXAMPLES 1 TO 6

As in the examples, aqueous cleaning solutions were prepared according to the formulations shown in Table 1.

TABLE 1

| | Inorganic acid | | Oxidized form metal ion | | Chelating | | | | Defoaming | Decomposition | |
|---|---|---|---|---|---|---|---|---|---|---|---|
| | $H_2SO_4$ | $NHO_3$ | $Fe^{3+}$ | $Ce^{4+}$ | agent | Surfactant | | | agent | preventing agent | |
| | g/L | g/L | g/L | g/L | g/L | Kinds | Molecular weight | g/L | g/L | g/L | pH |
| Example | | | | | | | | | | | |
| 1 | 12.5 | 1.0 | 1.0 | — | 1.0 | $C_{14}H_{29}$—O—$(EO)_{22}H$ | 1182 | 1.0 | 1.0 | 0.05 | 0.9 |
| 2 | 12.5 | 1.0 | 1.0 | — | 1.0 | $C_{12}H_{25}$—O—$(EO)_{22}H$ | 1154 | 1.0 | 1.0 | 0.05 | 0.9 |
| 3 | 12.5 | 1.0 | 1.0 | — | 1.0 | $C_{16}H_{33}$—O—$(EO)_{22}H$ | 1210 | 1.0 | 1.0 | 0.05 | 0.9 |
| 4 | 12.5 | 1.0 | 1.0 | — | 1.0 | $C_{14}H_{29}$—O—$(EO)_{14}H$ | 830 | 1.0 | 1.0 | 0.05 | 0.9 |
| 5 | 12.5 | 1.0 | 1.0 | — | 1.0 | $C_{14}H_{29}$—O—$(EO)_{14}H$ | 830 | 1.3 | 0.7 | 0.05 | 0.9 |
| 6 | 12.5 | 1.0 | 1.0 | — | 1.0 | $C_{14}H_{29}$—O—$(EO)_{10}H$ | 645 | 1.0 | 1.0 | 0.05 | 0.9 |
| 7 | 12.5 | 1.0 | 1.0 | | 1.0 | $C_{14}H_{29}$—O—$(EO)_{10}H$ | 645 | 1.3 | 0.7 | 0.05 | 0.9 |
| 8 | 12.5 | 1.0 | 1.0 | — | 1.0 | $C_{12}H_{25}$—O—$(EO)_{38}H$ | 1858 | 1.0 | 1.0 | 0.05 | 0.9 |
| 9 | 12.5 | — | 1.0 | — | 1.0 | $C_{14}H_{29}$—O—$(EO)_{22}H$ | 1182 | 1.0 | 1.0 | 0.05 | 0.9 |
| 10 | 10.0 | 3.5 | 1.0 | — | 1.0 | $C_{14}H_{29}$—O—$(EO)_{22}H$ | 1182 | 1.0 | 1.0 | 0.05 | 0.9 |
| 11 | 5.0 | 1.0 | 1.0 | — | 1.0 | $C_{14}H_{29}$—O—$(EO)_{22}H$ | 1182 | 1.0 | 1.0 | 0.05 | 1.8 |
| 12 | 12.5 | 1.0 | 0.2 | — | 0.1 | $C_{14}H_{29}$—O—$(EO)_{22}H$ | 1182 | 1.0 | 1.0 | 0.05 | 0.9 |
| 13 | 12.5 | 1.0 | — | 1.0 | 1.0 | $C_{14}H_{29}$—O—$(EO)_{22}H$ | 1182 | 1.0 | 1.0 | 0.05 | 0.9 |
| Comparative Example | | | | | | | | | | | |
| 1 | 12.5 | 1.0 | 1.0 | — | 1.0 | $C_9H_{19}$—P—O—$(EO)_{18}H$ | 1012 | 1.0 | 1.0 | 0.05 | 0.9 |
| 2 | 12.5 | 1.0 | 1.0 | — | 1.0 | $C_{14}H_{29}$—O—$(EO)_7H$ | 522 | 1.0 | 1.0 | 0.05 | 0.9 |
| 3 | 12.5 | 1.0 | 1.0 | — | 1.0 | $C_8H_{17}$—O—$(EO)_{22}H$ | 1098 | 1.0 | 1.0 | 0.05 | 0.9 |
| 4 | 12.5 | 1.0 | 1.0 | — | 1.0 | $C_{20}H_{41}$—O—$(EO)_{22}H$ | 1266 | 1.0 | 1.0 | 0.05 | 0.9 |
| 5 | 12.5 | 1.0 | 1.0 | — | 1.0 | Abietic acid derivative | 1622 | 1.0 | 1.0 | 0.05 | 0.9 |
| 6 | 12.5 | 1.0 | 1.0 | — | 1.0 | $C_{13}H_{27}$—COO$(EO)_{22}H$ | 1196 | 1.0 | 1.0 | 0.05 | 0.9 |

P in $C_9H_{19}$—P—O—$(EO)_{18}H$ represents a phenyl group.

Evaluation of Aqueous Cleaning Solutions

[Degreasing properties (relation between treating time for degreasing and cleaning properties)]

Degreasing treatments were conducted for 25 seconds and 45 seconds using each of the aqueous cleaning solutions. The cleaning properties were evaluated in terms of water-wettability, desmutting property, and blackening on container bottom.

Subjects of the cleaning test were open containers which were obtained by DI (drawing and ironing) of 3004 aluminum alloy sheets and which had lubricating oil and smut adhered thereto.

The evaluation results of cleaning properties are shown in Table 2.

TABLE 2

| | Cleaning properties | | | | | |
|---|---|---|---|---|---|---|
| | Water-wettability | | Desmuttng property | | Blackening on container bottom | |
| | 25 seconds | 45 seconds | 25 seconds | 45 seconds | 25 seconds | 45 seconds |
| Example | | | | | | |
| 1 | 100 | 100 | 5 | 5 | 5 | 5 |
| 2 | 100 | 100 | 5 | 5 | 5 | 5 |
| 3 | 100 | 100 | 5 | 5 | 5 | 5 |
| 4 | 100 | 100 | 5 | 5 | 5 | 5 |
| 5 | 100 | 100 | 5 | 5 | 5 | 5 |
| 6 | 100 | 100 | 5 | 5 | 5 | 5 |
| 7 | 100 | 100 | 5 | 5 | 5 | 5 |
| 8 | 100 | 100 | 5 | 5 | 5 | 5 |
| 9 | 100 | 100 | 5 | 5 | 5 | 5 |
| 10 | 100 | 5 | 5 | 5 | 5 | 5 |
| 11 | 100 | 5 | 5 | 5 | 5 | 5 |
| 12 | 100 | 100 | 5 | 5 | 5 | 5 |
| 13 | 100 | 100 | 5 | 5 | 5 | 5 |
| Comparative Example | | | | | | |
| 1 | 90 | 100 | 3 | 5 | 3 | 5 |
| 2 | 80 | 100 | 3 | 5 | 3 | 5 |
| 3 | 90 | 100 | 3 | 5 | 3 | 5 |
| 4 | 50 | 100 | 3 | 5 | 3 | 5 |

TABLE 2-continued

| | Cleaning properties | | | | | |
|---|---|---|---|---|---|---|
| | Water-wettability | | Desmuttng property | | Blackening on container bottom | |
| | 25 seconds | 45 seconds | 25 seconds | 45 seconds | 25 seconds | 45 seconds |
| 5 | 50 | 100 | 3 | 5 | 3 | 5 |
| 6 | 50 | 100 | 3 | 5 | 3 | 5 |

The evaluations of water-wettability, desmutting property, and blackening on container bottom listed in Table 2 were made according to the following criteria:

(1) Water-wettability

A container as a subject of cleaning test was sprayed with an aqueous cleaning solution heated to 70 to 75° C. for a prescribed period of time (25 seconds or 45 seconds), rinsed with tap water for 15 seconds, and thereafter swung 3 times for drainage. Then, the container was left to stand so that it faced upwardly and the water-wetted area (%) on outer surface of the container was visually measured at the point when 60 seconds passed.

(2) Desmutting Property

A container as a subject of cleaning test was sprayed with an aqueous cleaning solution heated to 70 to 75° C. for a prescribed period of time (25 seconds or 45 seconds), rinsed with tap water for 15 seconds, and thereafter dried. A transparent adhesive tape was adhered to the inner wall of the container after being dried and thereafter the tape was peeled from the inner wall. The peeled tape was then adhered to a white board. The whiteness of this tape was visually compared with the whiteness of a dirt-free tape which was also adhered to the white board. A stain-fee state by complete removal of smut was rated good and the level of stain was evaluated according to the following criteria:

5: free from stain

4: trace of stain

3: slight stain

2: moderate stain

1: remarkable stain (3) Blackening on Container Bottom

A container as a subject of cleaning test was sprayed with an aqueous cleaning solution heated to 70 to 75° C. for a prescribed period of time (25 seconds or 45 seconds), rinsed with tap water for 15 seconds, and thereafter sprayed for 15 seconds with a treating solution (at 40° C. and having a concentration of 1.7% by weight) containing "Alsurf 440 bath-making agent" (manufactured by Nippon Paint Co., Ltd.). Next, the container was rinsed with tap water, rinsed with deionized water, and then dried at 190° C. for 2 minutes. After being dried, the container was immersed in boiling water of 100° C. for 30 minutes. After the immersion, the level of blackening on container bottom was evaluated according to the following criteria:

5: entirely free from discoloration

4: trace of discoloration

3: slight discoloration

2: considerable discoloration

1: perfect blackening

[Durability of cleaning properties when oil accumulates (influence of amounts of accumulated lubricating oil on cleaning properties)]

In anticipation of the accumulation of oil in the cleaning bath as the cleaning operation proceeds, prescribed amounts (1.0 g/L, 2.0 g/L, and 3.0 g/L) of lubricating oil were added to the cleaning bath in advance and thus the cleaning properties of each of the aqueous cleaning solutions were evaluated. As in the test of the degreasing properties, subjects of the test were open containers which were obtained by DI (drawing and ironing) of 3004 aluminum alloy sheets and which had lubricating oil and smut adhered thereto.

The evaluation results of cleaning properties are shown in Table 3.

TABLE 3

| | Cleaning properties | | | | | | | | |
|---|---|---|---|---|---|---|---|---|---|
| | Water-wettability Lubricating oil (g/L) | | | Desmutting property Lubricating oil (g/L) | | | Blackening on container bottom Lubricating oil (g/L) | | |
| | 1.0 | 2.0 | 3.0 | 1.0 | 2.0 | 3.0 | 1.0 | 2.0 | 3.0 |
| Example | | | | | | | | | |
| 1 | 100 | 100 | 100 | 5 | 5 | 5 | 5 | 5 | 5 |
| 2 | 100 | 100 | 100 | 5 | 5 | 5 | 5 | 5 | 5 |
| 3 | 100 | 100 | 100 | 5 | 5 | 5 | 5 | 5 | 5 |
| 4 | 100 | 100 | 60 | 5 | 5 | 5 | 5 | 5 | 3 |
| 5 | 100 | 100 | 50 | 5 | 5 | 5 | 5 | 5 | 5 |
| 6 | 100 | 100 | 100 | 5 | 5 | 5 | 5 | 5 | 3 |
| 7 | 100 | 100 | 100 | 5 | 5 | 5 | 5 | 5 | 5 |
| 8 | 100 | 100 | 100 | 5 | 5 | 5 | 5 | 5 | 5 |
| 9 | 100 | 100 | 100 | 5 | 5 | 5 | 5 | 5 | 5 |
| 10 | 100 | 100 | 100 | 5 | 5 | 5 | 5 | 5 | 5 |
| 12 | 100 | 100 | 100 | 5 | 5 | 5 | 5 | 5 | 5 |
| 13 | 100 | 100 | 100 | 5 | 5 | 5 | 5 | 5 | 5 |
| 14 | 100 | 100 | 100 | 5 | 5 | 5 | 5 | 5 | 5 |
| Comparative Example | | | | | | | | | |
| 1 | 80 | 50 | 40 | 5 | 3 | 3 | 4 | 3 | 2 |
| 2 | 70 | 30 | 20 | 4 | 2 | 2 | 3 | 2 | 2 |
| 3 | 40 | 30 | 20 | 4 | 2 | 2 | 3 | 2 | 2 |
| 4 | 40 | 30 | 20 | 5 | 3 | 2 | 4 | 3 | 2 |
| 5 | 40 | 30 | 20 | 4 | 2 | 2 | 3 | 2 | 2 |
| 6 | 40 | 20 | 20 | 3 | 2 | 2 | 2 | 1 | 1 |

The evaluations of water-wettability, desmutting property, and blackening on container bottom listed in Table 3 were conducted as in the evaluation of degreasing property ,except that the spraying time for treatment in the test of water-wettability was 25 seconds.

[Resistance to oxidative decomposition]

An aqueous cleaning solution was heated to 75° C. and aluminum was etched in the solution. While the etching treatment continued, hydrogen peroxide was fed solution so that the oxidation-reduction potential of the solution was maintained at 540 mV. At the point when 1 hour passed, the amount of the surfactant was measured. In addition, at the same point, an aluminum container prepared in the above-described way was cleaned using the solution and the cleaning properties were evaluated as "cleaning properties of a cleaning solution after aging". The results are shown in Table 4.

TABLE 4

| | Cleaning properties | | | Percentage of |
|---|---|---|---|---|
| | Water-wettability | Desmutting property | Blackening on container bottom | remaining surfactant (%) |
| Example | | | | |
| 1 | 100 | 5 | 5 | 80 |
| 2 | 100 | 5 | 5 | 80 |
| 3 | 100 | 5 | 5 | 80 |
| 4 | 80 | 5 | 4 | 80 |
| 5 | 100 | 5 | 5 | 80 |
| 6 | 70 | 5 | 4 | 80 |
| 7 | 100 | 5 | 5 | 80 |
| 8 | 100 | 5 | 5 | 80 |
| 9 | 100 | 5 | 5 | 80 |
| 10 | 100 | 5 | 5 | 80 |
| 11 | 100 | 5 | 5 | 85 |
| 12 | 100 | 5 | 5 | 90 |
| 13 | 100 | 5 | 5 | 80 |
| Comparative Example | | | | |
| 1 | 60 | 4 | 3 | 60 |
| 2 | 50 | 4 | 3 | 80 |
| 3 | 50 | 4 | 3 | 80 |
| 4 | 30 | 4 | 3 | 80 |
| 5 | 10 | 3 | 2 | 30 |
| 6 | 10 | 3 | 2 | 20 |

The evaluation of the cleaning properties of a cleaning solution after aging was conducted as in the evaluation of durability of cleaning properties when oil accumulated.

The amount of remaining surfactant was calculated by measuring the amount of remaining surfactant in accordance with a Cesibor method.

(4) Procedure for Measuring the Concentration of a Surfactant in Accordance with a Cesibor Method.

take out 0.5 mL of sample (aqueous acid cleaning solution)

dilute the sample with 10 mL of pure water add 5 mL of 6N-KOH aqueous solution to the solution of the preceding step add 2 drops of Victoria Blue indicator to the solution of the preceding step The Victoria Blue indicator was prepared by dissolving 1 g of Victoria Blue B in 250 mL of ethanol.

add 5 mL of 1,2-dichloroethane to the preceding solution titrate the solution with a Cesibor solution by taking as end point the coloration of brilliant blue.

The Cesibor solution was prepared by dissolving 0.2251 g of Cesibor ($C_{24}H_{16}BF_4Na.2H_2O$) in 1 L of pure water.

For the determination of the concentration, a calibration curve was prepared in advance with the surfactant to be used.

What is claimed is:

1. An aqueous cleaning solution for aluminum-based metals which comprises an inorganic acid in an amount to provide a pH value of 2 or less, an oxidized form metal ion in an amount of 0.05 to 4 g/L, and a surfactant in an amount of 0.05 to 10 g/L; said surfactant is represented by the following formula (I)

$$R—O—(EO)_nH \quad (I)$$

wherein R represents an alkyl group having 10 to 18 carbon atoms per molecule on average, n represents an integer of 8 or greater, and EO represents an ethyleneoxy group which may contain a small proportion of a propyleneoxy group.

2. An aqueous cleaning solution according to claim 1 wherein R of the surfactant represented by the formula (I) has 12 to 18 carbon atoms per molecule on average and has a molecular weight of 600 or greater.

3. An aqueous cleaning solution according to claim 1 wherein R of the surfactant represented by the formula (I) has 12 to 18 carbon atoms per molecule on average and has a molecular weight of 900 or greater.

4. An aqueous cleaning solution according to claim 1 or 2, wherein the oxidized form metal ion is one or more selected from the group consisting of a ferric ion ($Fe^{3+}$), a ceric ion ($Ce^{4+}$), a cobalt ion ($Co^{5+}$), and a stannic ion ($Sn^{4+}$).

5. An aqueous cleaning solution according to any one of claims 1 to 3 which additionally comprises at least one component selected from a chelate dispersant, a decomposition preventing agent, and a defoaming agent.

6. A process for cleaning aluminum-based metals by the aqueous cleaning solution described in any one of claims 1 to 3 comprising contacting said aluminum-based metal with said aqueous cleaning solution wherein the concentration of the oxidized form metal ion in the aqueous cleaning solution is maintained by supplementing an oxidizing agent or an oxidizing agent and an oxidized form metal ion.

7. A process for cleaning aluminum-based metals by the aqueous cleaning solution described in claim 4 comprising contacting said aluminum-based metal with said aqueous cleaning solution wherein the concentration of the oxidized form metal ion in the aqueous cleaning solution is maintained by supplementing an oxidizing agent or an oxidizing agent and an oxidized form metal ion.

* * * * *